US005497589A

United States Patent [19]

Porter

[11] Patent Number: 5,497,589

[45] Date of Patent: Mar. 12, 1996

[54] STRUCTURAL INSULATED PANELS WITH METAL EDGES

[76] Inventor: William H. Porter, P.O. Box 249, Saugatuck, Mich. 49453

[21] Appl. No.: 273,981

[22] Filed: Jul. 12, 1994

[51] Int. Cl.[6] ..... E04C 2/296; E04C 2/30

[52] U.S. Cl. ..... 52/309.7; 52/309.2; 52/309.9; 52/592.1; 52/784.15; 52/787.1; 52/794.1; 52/797.1; 52/800.1; 52/801.1

[58] Field of Search ..... 52/309.2, 309.7, 52/309.9, 592.1, 784.15, 787.1, 794.1, 797.1, 800.1, 801.1

[56] References Cited

U.S. PATENT DOCUMENTS

| | | | |
|---|---|---|---|
| 3,546,841 | 12/1970 | Smith et al. | 52/784.15 X |
| 3,786,611 | 1/1974 | Brown et al. | 52/309.2 |
| 4,125,984 | 11/1978 | Jonas | 52/794.1 |
| 4,236,366 | 12/1980 | Bijnders | 52/592.1 X |
| 4,283,898 | 8/1981 | Claver | 52/309.9 X |
| 4,575,981 | 3/1986 | Porter | 52/309.9 |
| 5,373,678 | 12/1994 | Hesser | 52/592.1 |

FOREIGN PATENT DOCUMENTS

| | | | |
|---|---|---|---|
| 2436222 | 5/1980 | France | 52/309.9 |

*Primary Examiner*—Carl D. Friedman
*Assistant Examiner*—Christopher Todd Kent
*Attorney, Agent, or Firm*—Emrich & Dithmar

[57] ABSTRACT

A generally flat structural panel includes a center foam core and opposed outer facings, or sheets, with a metal insert disposed about and attached to the edges of the core and at least one of the outer facings. The metal edge insert provides high strength for the insulated foam panel, eliminates the need for structural members such as studs which act as thermal conductors, and facilitates coupling between adjacent panels, ceilings and floors using various connection arrangements. The structural insulated panels also form the basis of a modular construction system that allows for the use of standard size inside and outside panels of the same size which form a grid in which the outside panels always enclose an area that is a multiple of the module. In one embodiment, a lateral surface of the foam core is provided with a linear array of recesses, or grooves, and a facing is attached to that surface in the field to permit electrical wire routing in the recesses, as required, at the construction site. In another embodiment, metal strips attached to the surface of the core and adapted for secure attachment to a facing such as of drywall provide a space between the foam core and drywall sheet for wire routing.

13 Claims, 10 Drawing Sheets

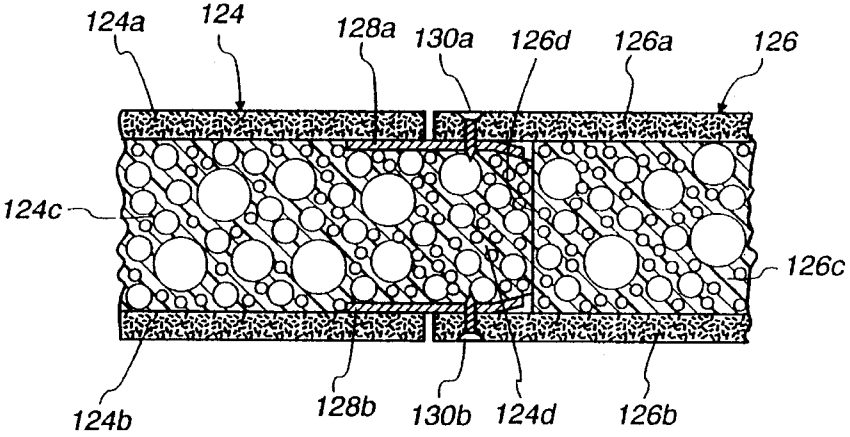
Fig. 6
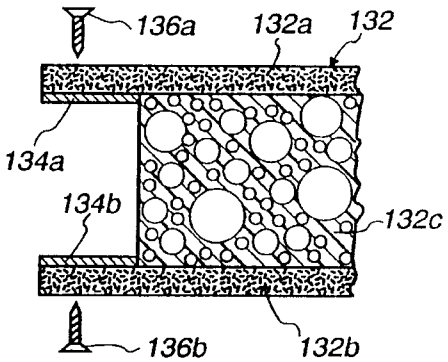
Fig. 7
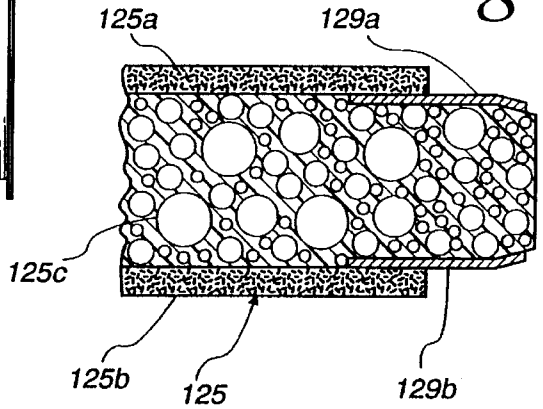
Fig. 5
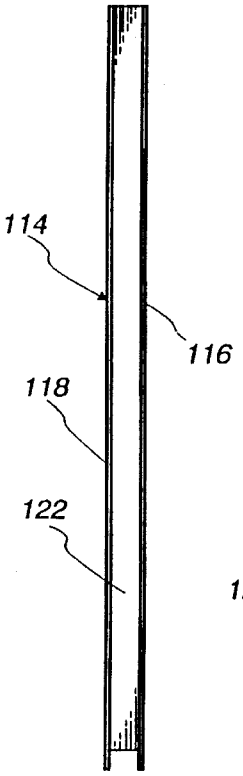
Fig. 3
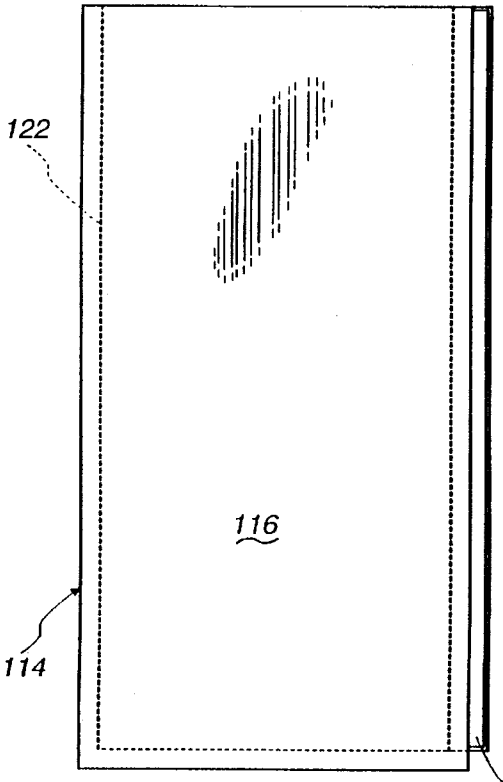
Fig. 4
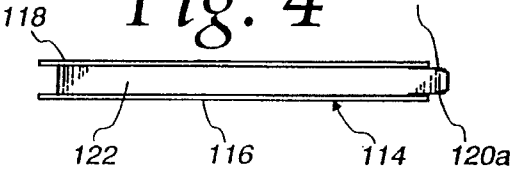

STRUCTURAL INSULATED PANELS WITH METAL EDGES

FIELD OF THE INVENTION

This invention relates generally to structural panels for buildings and is particularly directed to structural insulated panels having a foam core, opposed facings of common structural materials attached to the core, and a metal peripheral edge bonded to the edges of the core and facings.

BACKGROUND OF THE INVENTION

The traditional house is stick built, i.e., constructed of 2× dimensional structural lumber members and nails. This method of construction is slow and manpower intensive, requires a large supply of a limited commodity, and affords a limited number of structural shapes.

Another construction approach uses Structural Insulated Panels (SIPs). The basic structural unit in the SIP construction approach employs two rigid faces on either side of a light insulated foam core. This approach requires good adhesion of the faces to the core to form a structural I-beam. Panels of this type are also joined with lumber and nails.

A more recent approach uses steel studs rather than the 2× dimensional lumber approach. Substituting steel for lumber increases material and labor costs. In addition, steel is a good thermal conductor which gives rise to an increase in energy loss on the order of 50% over the conventional lumber construction approach if steel studs are installed between the inside and outside casings of the panels. Using steel and studs as a replacement for lumber also does not make optimum use of the positive structural characteristics of steel as a building material. In addition, SIPs are typically made with rather thick facings as compared to metal edging. SIP panel facings are typically on the order of 0.25" to 0.75" in thickness in the form of a flat sheet that is not readily formed. The junctures of such panels typically employ a lumber spline with nails and screws for joining. Building supply centers stock such building components pre-hung, pre-finished, and pre-assembled with the exception of the main structure of the house. This limits variation in house construction and design.

The present invention addresses the aforementioned limitations of the prior art by providing a structural insulated panel with metal edges disposed about and securely attached to a center foam core and outer opposed facings affixed to the center core.

OBJECTS AND SUMMARY OF THE INVENTION

Accordingly, it is an object of the present invention to provide a structural insulated panel with improved strength which can be assembled in the field for custom applications.

It is another object of the present invention to provide a metal strip around the peripheral edge of a foam core, sandwich-type structural panel for substantially increasing the strength of the panel, facilitating panel connection to adjacent, similar panels, and other structural members, and reducing heat transfer between the surfaces of a wall formed of a plurality of such panels.

Yet another object of the present invention is to provide an open face structural panel having a foam core with a plurality of spaced fastening access grooves for accommodating wire runs within the panel.

A further object of the present invention is provide a modular building system using standard size structural panels and employing a grid wherein the outer panels enclose an area which is a multiple of the basic module and the inner and outer panels are of the same size.

This invention contemplates laminating a light gauge metal section on the edge of a bonded panel with thick facings. The metal may be on the inside or outside edge of the panel and does not extend through the panel so as to act as a conductor for heat loss. The metal edge portion may be on one or all of the edges of the panel, with the metal edge joined structurally at the corners in the latter case. The metal edge may be flat or contoured and is easily laminated into the structural insulated panel because the panel's plastic foam core is sufficiently compressible (without machining the foam) to allow for easy bonding. The panel's thick outer facings are generally comprised of a conventional building material such as plywood, oriented strand board, drywall, composite gypsum with recycled newsprint, or other rigid production boards from ¼" to ¾" thick. The metal edging is preferably galvanized steel, but may also be aluminum or painted steel or even a thin structural plastic. The panel's inner core may be expanded polystyrene, extruded polystyrene, urethane, polyisocyanurate or other conventional insulating material. Non-plastic insulating materials such as paper, egg crate, honey comb, and straw board may also be used. The metal edges may serve as self-aligning splines or recesses for screwing or bolting panels together. The metal edge may assume virtually any shape depending upon the use of the structural panels in the construction. For exterior wall panels, a spline system, a toe screw system, or an open channel bolt-together arrangement may be used. For roof panels, the spline system is preferred. For interior walls, a ship lap side panel junction allows for a four corner connection while still maintaining a module connection. When steel is used for the metal edging, a less costly facing material may be used because the steel carries much of the load. The edging need only be attached to one of the panel facings because it is a fully adhered component of the panel, with attachment to only one side of the panel substantially improving the panel's insulation value as the steel edging does not function as a through conductor.

Several types of panel-to-panel junctures may be employed with the peripheral metal edging of the present invention. The junctures can be an open or closed system. The open system has an open recess at the panel edge and connection is made in the open slot. A closed system employs a solid panel with a minimum number of holes through the panel required for connection. Screws, wedges, or cam-lock connection devices can be used with a closed system.

The open or closed type of connection allows for precise connection between panels and also permits the panels to be disconnected and reconnected. Structural insulated panels in accordance with the present invention thus provide flexibility for changing panel configuration or building expansion without destruction of components. The connection in the open system can be made easily with nut and bolt combinations with the bolts acting as alignment pins so that panels can be easily and quickly assembled. The open system allows for a wiring chase in the fastening access groove, with additional wiring chases provided through the panel. Structural insulated panels in accordance with the present invention can be mass-produced in a variety of shapes and provided to local building centers where homes can be purchased as a series of pre-fabricated panels. The homes cannot only be erected using a bolt together system, but also can be changed without destroying the building structure components.

Another aspect of this invention contemplates a modular system that allows buildings to be constructed with panels of a standard size. The panels work off a grid in which the outside panels always enclose, or form the perimeter of, an area that is a multiple of the module. The inside panels work off of the same module using the same model and ship lap ends to allow for corner junctures.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIGS. 3, 4, and 5 are front elevation, top plan, and lateral elevation views of a structural insulated panel in accordance with the present invention;

FIG. 6 is a partial sectional view illustrating the manner in which a pair of structural insulated panels as shown in FIGS. 3, 4 and 5 may be connected together;

FIG. 7 is a partial sectional view of a pair of structural insulated panels in accordance with another embodiment of the present invention;

FIG. 28 is a sectional view of the panel taken along site line 28—28 in FIG. 26.

DETAILED DESCRIPTION OF THE PREFERRED EMBODIMENTS

Figure 1:
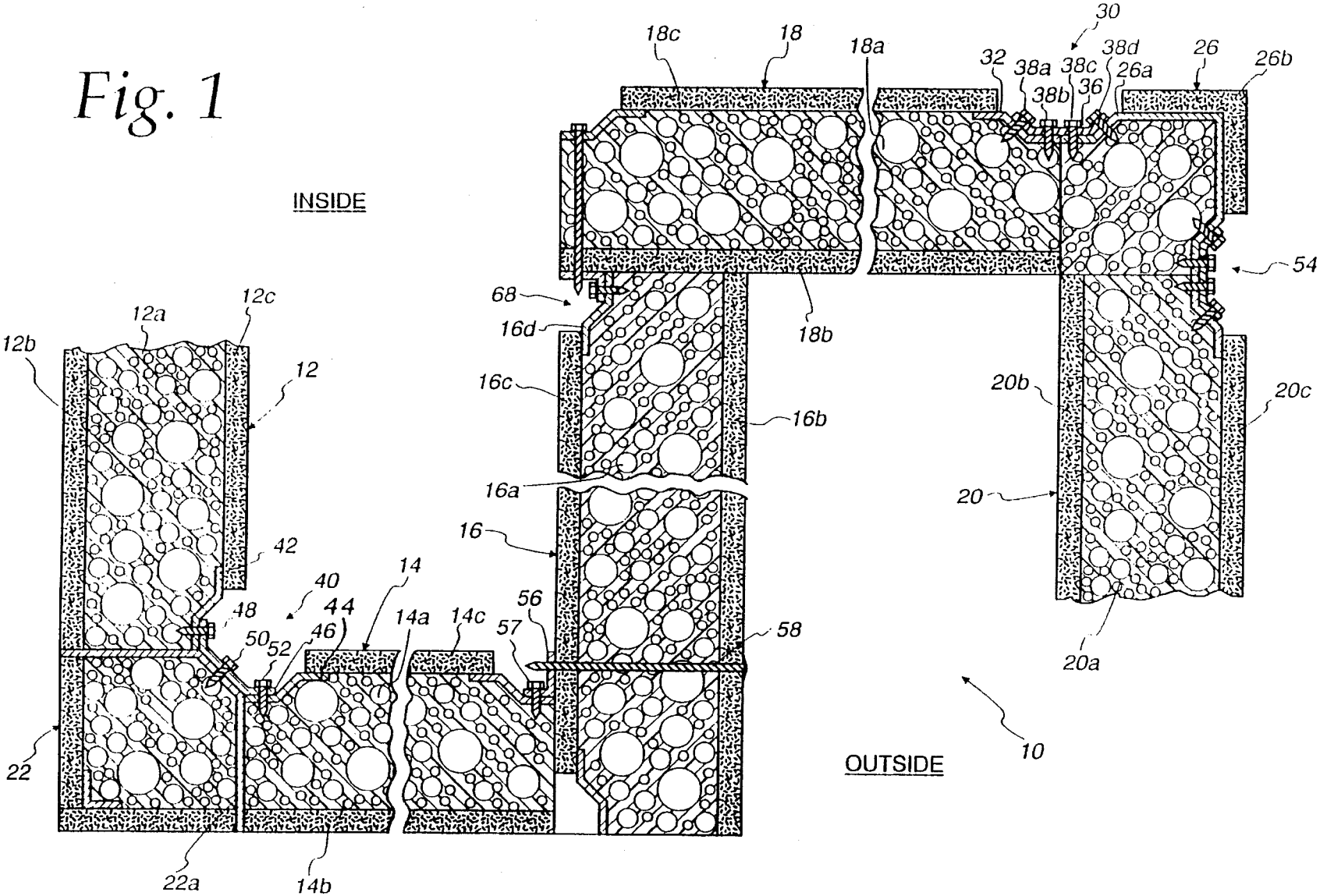
FIG. 1 is a horizontal-sectional view of a modular arrangement for a building structure incorporating structural insulated panels in accordance with the present invention.

Referring to FIG. 1, there is shown a horizontal sectional view of a modular system 10 including a plurality of insulated structural panels for use in building construction in accordance with one aspect of the present invention. The modular system 10 includes first, second, third, fourth, and fifth structural insulated panels 12, 14, 16, 18 and 20. Each of the structural insulated panels includes a foam core and opposed outer and inner facings. Thus, first panel 12 includes an inner foam core 12*a* and outer and inner facings 12*b* and 12*c*. The second panel 14 includes foam core 14*a* and outer and inner facings 14*b* and 14*c*. The third panel 16 includes foam core 16*a* and outer and inner facings 16*b* and 16*a*, respectively. Finally, the fourth and fifth panels 18 and 20 respectively include foam cores 18*a* and 20*a*, outer facings 18*b* and 20*b* and inner facings 18*c* and 20*c*. The modular system 10 further includes an outer corner 22 coupled to the first and second panels 12, 14 and an inner corner 26 coupled to the fourth and fifth panels 18, 20 as described below.

The first panel 12 includes a metal edge 42 which is inserted between the panel's inner foam core 12*a* and its inner facing 12*c*. An adhesive is applied to metal edge 42 for securely affixing it to the panel's foam core 12*a* and inner facing 12*c*. Metal edge 42 extends over the entire peripheral edge portion of the panel. Similarly, the second panel 14 includes a metal edge 44 extending around its peripheral edges which is coupled to the panel's inner foam core 14*a* and inner facing 14*c* by means of a conventional adhesive such as an epoxy cement or glue. Coupling arrangement 40 connects the first and second panels 12, 14 to the outside corner 22 by means of the combination of a metal channel connecting strip 46 and a plurality of screws 48, 50 and 52. Thus, screw 48 is inserted through the connecting strip 46 and metal edge 42, screw 50 is inserted through the connecting strip and the outside corner's inner metal facing 22*a*, and screw 52 is inserted through metal edge 44 and the connecting strip. Similarly, another portion of the metal edge in combination with a connecting angle 56, screw 57 and drywall screw 58 is used to securely couple the second panel 14 to the third panel 16. A similar coupling arrangement 68 attaches the opposing edge of the third panel 16 to the fourth panel using a metal edge 16*d* of the third panel 16.

Inner corner 26 includes an inner metal bracket 26*a* and an outer facing 26*b* on two sides thereof. Another coupling arrangement 30 connects the fourth panel 18 to the inside corner 26 along adjacent edges thereof in the following manner. The fourth panel 14 includes a metal edge 32 extending around the periphery thereof and securely attached to the panel's foam core 18*a* and inner facing 18*c* by means of an adhesive. Similarly, the inner metal bracket 26*a* of the inside corner 26 is affixed to the corner's foam core and outer facing 26*b* by means of an adhesive. A metal channel connecting strip 36 is disposed in contact with the fourth panel's metal edge 32 and the inside corner's inner metal bracket 26*a* and screws 38*a* and 38*b* are inserted through the connecting strip and metal edge 32 and screws 38*c* and 38*d* are inserted through metal channel connecting strip 36 and the inside corner's inner metal bracket 26*a*. First and fourth screws 38*a* and 38*d* draw the fourth panel 18 and the inner corner 26 together in tight fitting engagement when tightened. A similar coupling arrangement 54 connects the inside corner 26 to the fifth panel 20 as shown in FIG. 1.

Figure 2:
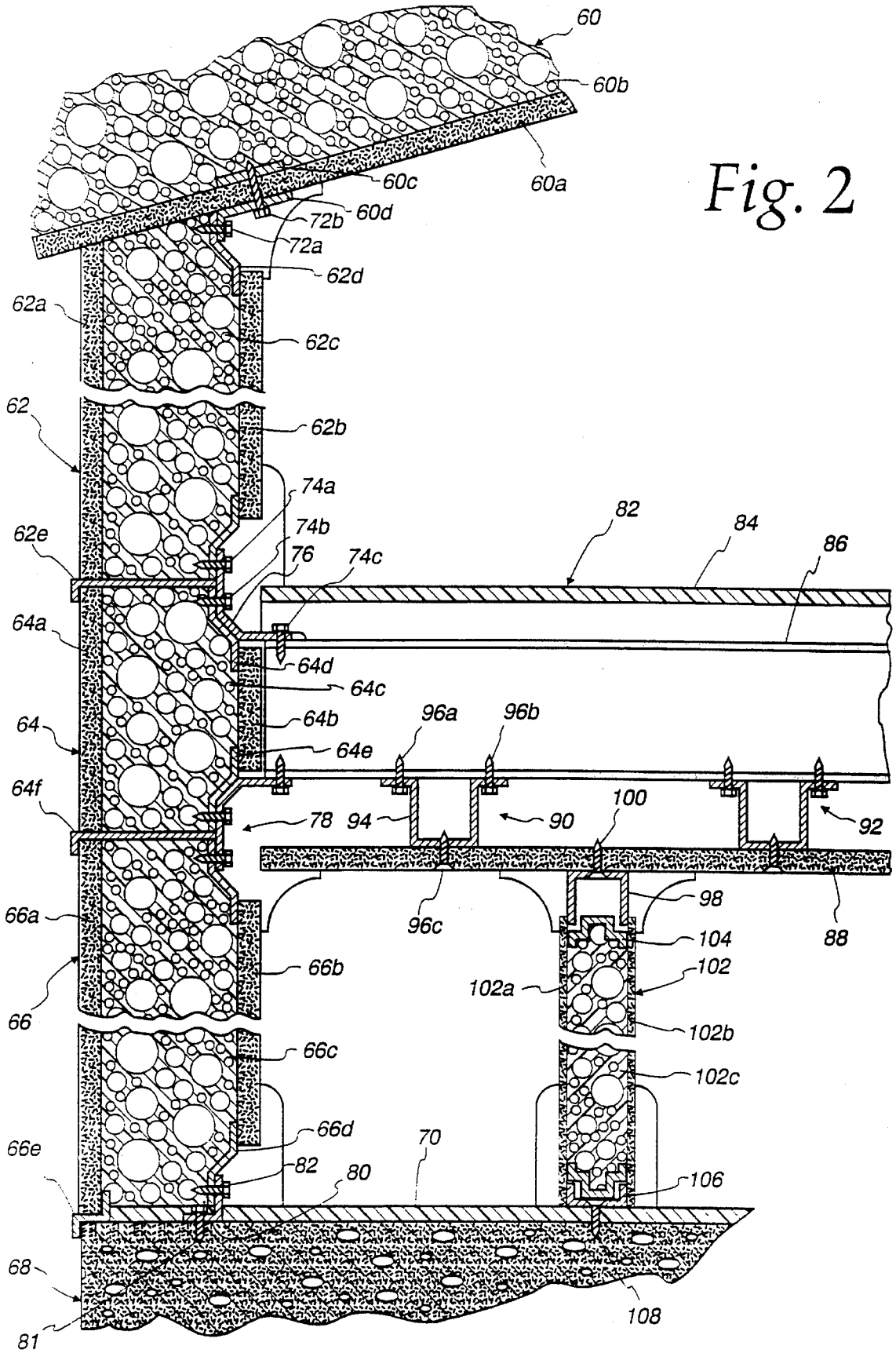
FIG. 2 is a generally vertical sectional view illustrating details of the manner in which a structural insulated panel in accordance with the present invention may be attached to roof, floor, ceiling and structural support members in accordance with the present invention.

Referring to FIG. 2, there is shown a sectional view of another arrangement incorporating structural insulated panels in accordance with the present invention. FIG. 2 shows a roof panel 60 coupled to and supported by first, second, and third wall panels 62, 64 and 66 which, in turn, are attached to and supported by a concrete foundation 68. Attached to an upper surface of the concrete foundation 68 is finished flooring 70. The third wall panel 66 includes an outer facing 66*a*, an inner facing 66*b*, and an insulating foam core 66*c*. Similarly, the first and second structural insulated panels 62 and 64 respectively include outer facings 62*a* and 64*a*, inner facings 62*b* and 64*b*, and insulating foam cores 62*c* and 64*c*, respectively. Roof panel 60 includes a lower panel 60*a*, a foam core 60*b*, and upper facing (which is not shown in the figure for simplicity). The first, second, and third wall panels 62, 64 and 66 each have a respective peripheral metal edge 62*d*, 64*d* and 66*d* disposed about the inner periphery thereof. The first panel's metal edge 62*d* is adhered to the panel's foam core 62*c* and inner facing 62*b*. Similarly, the peripheral metal edges 64*d* and 66*d* of the second and third panels 64, 66 are adhered to the foam cores 64*c* and 66*c* and inner facings 64*b* and 66*b* of these respective panels.

Disposed in the roof panel 60 is a metal coupling bracket 60*c*. The roof panel 60 is connected to the first panel's metal edge 62*d* by means of the combination of a coupling bracket 60*d* and a pair of screws 72*a* and 72*b*. Screw 72*a* is inserted through coupling bracket 60*d* and the first panel's metal edge 62*d*, while screw 72*b* is inserted through coupling brackets 60*c* and 60*d*. Peripheral metal edge 62*d* is also used for connecting the first panel 62 to the second panel 64 by means of a combination of coupling bracket 76, screws 74*a* and 74*b*, and the second panel's peripheral metal edge 64*d*. Disposed intermediate the first and second structural insulated panels 62 and 64 is a panel edge strip 62*e*. A similar coupling arrangement 78 is used to securely connect the second panel 64 to the third panel 66, with an edge strip 64*f* disposed intermediate the second and third panels. The second panel 64 is shorter than the first and third panels 62, 66 to accommodate the thickness of a second floor 82 described below. The lower edge of the third panel 66 is coupled by means of its peripheral metal edge 66*d* to the concrete foundation 68 by means of the combination of screws 81 and 82 and coupling angle 80. An outer peripheral metal edge 66*e* of the third panel 66 is affixed to the panel's foam core 66*c* and outer facing 66*a* and engages and rests upon the concrete foundation 68.

An interior wall panel 102 in accordance with the present invention includes first and second outer facings 102*a* and 102*b* and a foam core 102*c* disposed therebetween. A generally U-shaped peripheral metal edge 104 is disposed about the periphery of the panel's foam core 102*c* and is attached to peripheral edge portions of the two outer panels 102*a*, 102*b*. A lower edge of the structural insulated panel 102 is maintained in position on the foundation's flooring 70 by means of a combination of a U-shaped mounting bracket 106 and screw 108. The panel's peripheral metal edge 104 is inserted in U-shaped mounting bracket 106 and is securely maintained in fixed position on the concrete foundation 68. An upper portion of the panel's peripheral metal edge 104 is positioned within an upper U-shaped mounting bracket 98 which is attached to the ceiling 88 of the second floor 82 by means of screws 100. Channels formed in the upper edge of the interior wall panel 102 by its peripheral metal edge 104 receive the upper mounting bracket 98 and permit the wall panel to be raised, allowing its lower portion to be removed from the lower mounting bracket 106 for relocating or removing the wall panel.

Second floor 82 includes a plurality of spaced floor joists 86 connected to the second wall panel 64 by means of the combination of coupling bracket 76 and screws 74*c* and coupling arrangement 78. An end of floor joist 86 is disposed in contact with the second wall panel's inner facing 64*b*. Ceiling 88 is suspended from the floor joist 86 by means of a plurality of brackets such as brackets 92 and 94 attached to the floor joist 86 as well as to the ceiling 88 by means of a plurality of screws 96*a*, 96*b* and 96*c*. Disposed on the upper surface of the floor joist 86 is a floor surface 84 such as of carpet.

Referring to FIGS. 3, 4, and 5, there are respectively shown front elevation, top plan, and lateral elevation views of a structural insulated panel 114 in accordance with another embodiment of the present invention. Structural panel 114 includes an inner foam core 122 and first and second outer facings 116 and 118. Disposed along an edge of the structural panel 114 are first and second spaced metal strips 120*a* and 120*b*. Each of the first and second metal strips 120*a*, 120*b* is attached to an edge of the foam core 122 and two respective inner edge portions of the first and second panels 116, 118 by means of an adhesive.

Additional details of the structural insulated panel of FIGS. 3, 4 and 5 as well as details of the coupling between adjacent similar panels is shown in the sectional view of FIG. 6. In FIG. 6, a first structural insulated panel 124 is attached to a second, identical structural insulated panel 126. The first structural insulated panel includes first and second outer facings 124*a*, 124*b* and an inner foam core 124*c*. Similarly, the second structural insulated panel 126 includes first and second outer facings 126*a* and 126*b* and an inner foam core 126*c*. Disposed along an edge of the first structural insulated panel 124 are first and second metal edge strips 128*a* and 128*b*. Disposed along an opposing edge of the first panel 124 is a recessed portion as shown in the second structural insulated panel 126 which is adapted for receiving the first and second metal edge strips 128*a* and 128*b* as shown in the figure. First and second screws 130*a* and 130*b* inserted through the first and second outer facings 126*a*, 126*b* as well as through the metal edge strips 128*a*, 128*b* securely maintain the first and second panels 124, 126 connected together in a tongue and groove arrangement. The extended portion 124*d* of the first panels foam core 124*c* is positioned in abutting contact with the recessed edge 126*d* of the second panel's foam core 126*c*.

Referring to FIG. 7, there is shown a sectional view of a pair of panels 125 and 132 in accordance with another embodiment of the present invention. The first panel 125 includes first and second outer facings 125*a*, 125*b*, a foam core 125*c*, and first and second metal edge strips 129*a* and 129*b*. The second panel 132 includes first and second outer facings 132*a* and 132*b* as well as an inner foam core 132*c*. In the recessed end portion of the second panel are disposed first and second metal edge strips 134*a* and 134*b*. The extended lateral edge of the foam core 125*c* and first and second metal edge strips 129*a*, 129*b* of the first panel 125 are adapted for insertion in the recessed edge portion of the second panel 132. With the respective edge portions of the first and second panels 125, 132 disposed in abutting contact, first and second screws 136*a* and 136*b* are inserted through the metal edge strips 134*a*, 134*b* of the second panel 132 and the metal edge strips 129*a*, 129*b* of the first panel 125 for securely coupling the two panels along their respective abutting edges.

Figure 8:
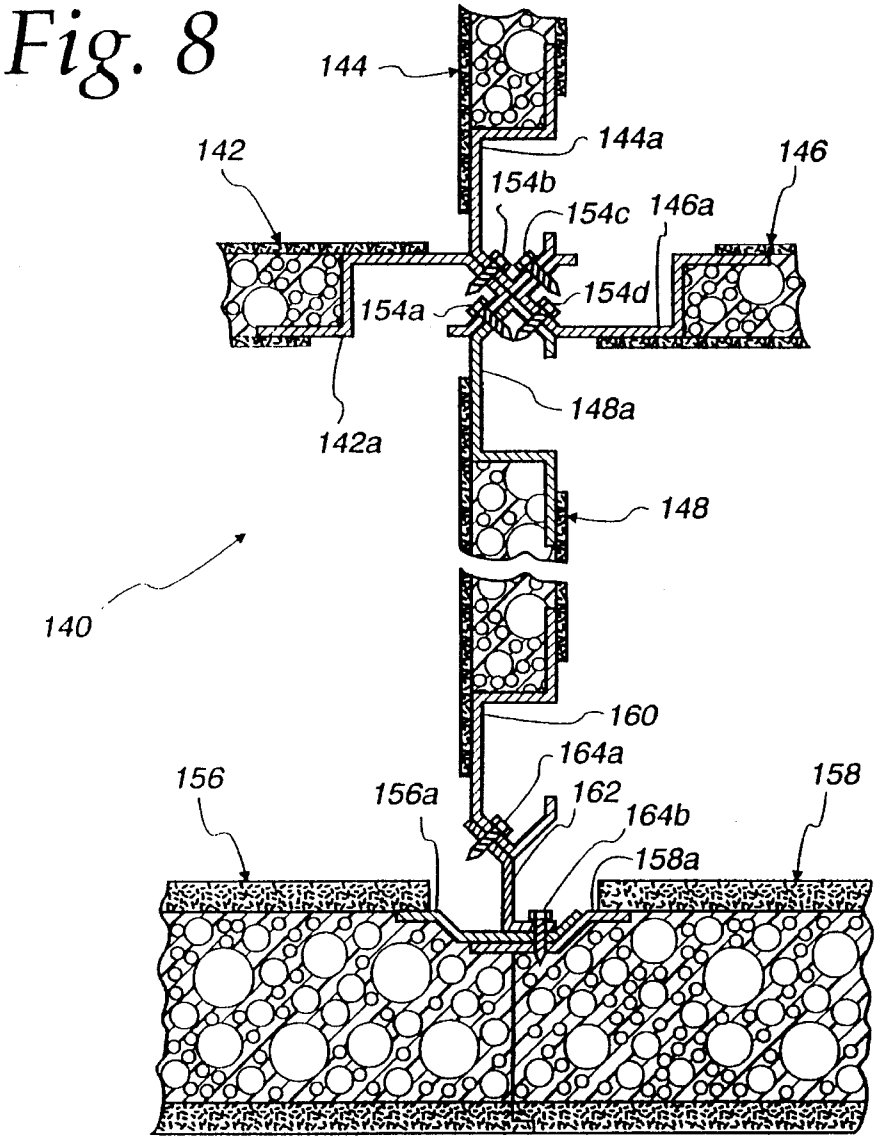
FIG. 8 is a partial sectional view of another coupling arrangement for a plurality of structural insulated panels in accordance with another embodiment of the present invention incorporated as walls in a building structure.

Referring to FIG. 8, there is shown a generally horizontal sectional view of a panel coupling arrangement 140 employing metal edge strips in accordance with another aspect of the present invention. The panel coupling arrangement 140 couples first, second, third and fourth interior insulated panels 142, 144, 146 and 148 together. The panel coupling arrangement 140 of FIG. 8 also securely couples first and second exterior panels 156 and 158 together as well as to the fourth interior insulated panel 148. As in the previously described embodiments, all of the panels shown in FIG. 8 include first and second outer facings and an inner foam core. The insulated interior panels 142, 144, 146 and 148 respectively include metal edge strips 142*a*, 144*a*, 146*a* and 148*a*. Each of the metal edge strips is securely bonded to the outer facing and inner core of its associated panel structure. Each of the metal edge strips 142*a*, 144*a*, 146*a* and 148*a* includes an angled distal portion having a respective aperture therein allowing the four metal edge strips to be securely joined as shown in the figure. With the four metal edge strips arranged as shown in FIG. 8, self-tapping screws 154*b* and 154*d* are respectively inserted through metal edge strips 142*a*, 144*a* and 146*a*, 148*a*. The access provided by the coupling arrangement 140 shown in FIG. 8 allows screws 154*b* and 154*d* to be driven in by a power drive such as a power screw driver rather than by a hand-operated ratchet tool. Self-tapping screws 154*a* and 154*c* may also be respectively inserted through metal edge strips 142*a*, 148*a* and 144*a*, 146*a* for increasing the strength of the panel coupling arrangement 140 shown in FIG. 8.

Metal edge strip 160 attached to the opposing edge of the fourth insulated interior panel 148 also includes a pointed distal end portion having an aperture therethrough. Metal edge strip 160 is attached to the first and second exterior panels 156 and 158 by means of the combination of screws 164*a* and 164*b*, connecting bracket 162, and metal edge connecting strips 156*a* and 158*a* disposed respectively in the first and second exterior panels 156, 158. Screw 164*a* is inserted through aligned apertures in metal edge connecting strip 160 and connecting bracket 162. Similarly, screw 164*b* is inserted through aligned apertures in connecting bracket 162 and the metal edge connecting strips 156*a*, 158*a* of the first and second exterior panels 156, 158.

Figure 9:
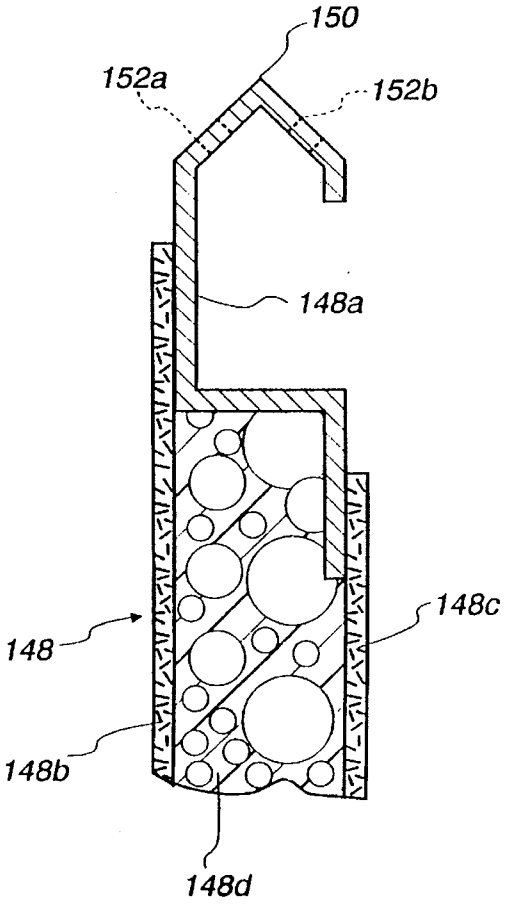
FIG. 9 is a partial sectional view of an edge of one of the structural insulated panels shown coupled together in FIG. 8.

Referring to FIG. 9, there is shown additional details of the metal edge strip 148*a* of the fourth insulated interior panel 148. The distal angled portion 150 of the metal edge strip 148*a* facilitates secure connection of the interior insulated panel 148 to one or more similar panels by means of screws (not shown) inserted through apertures 152*a* and 152*b* in the distal end portion of the metal edge strip. Metal edge strip 148*a* is attached to the outer panels 148*b*, 148*c* and the foam core 148*d* of the interior insulated panel 148 by conventional means such as an adhesive.

Figure 10:
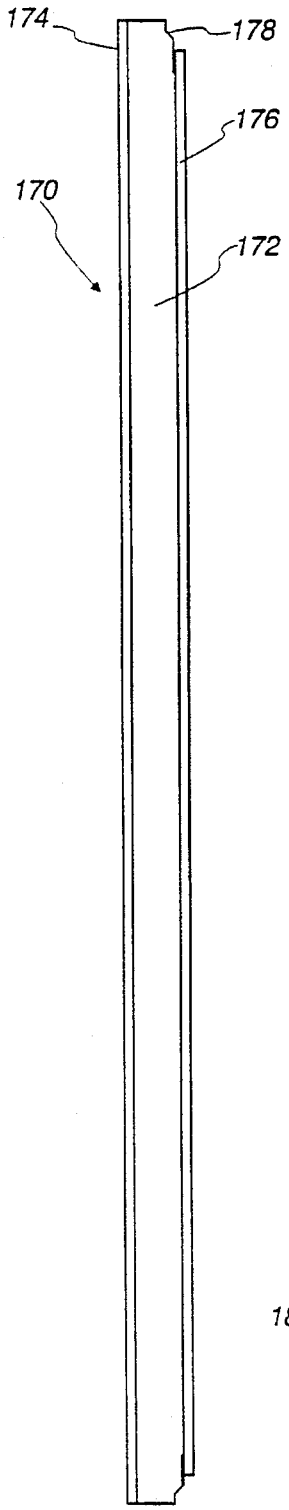
FIG. 10 is a side elevation view of another embodiment of a structural insulated panel in accordance with the present invention.
Figure 11:
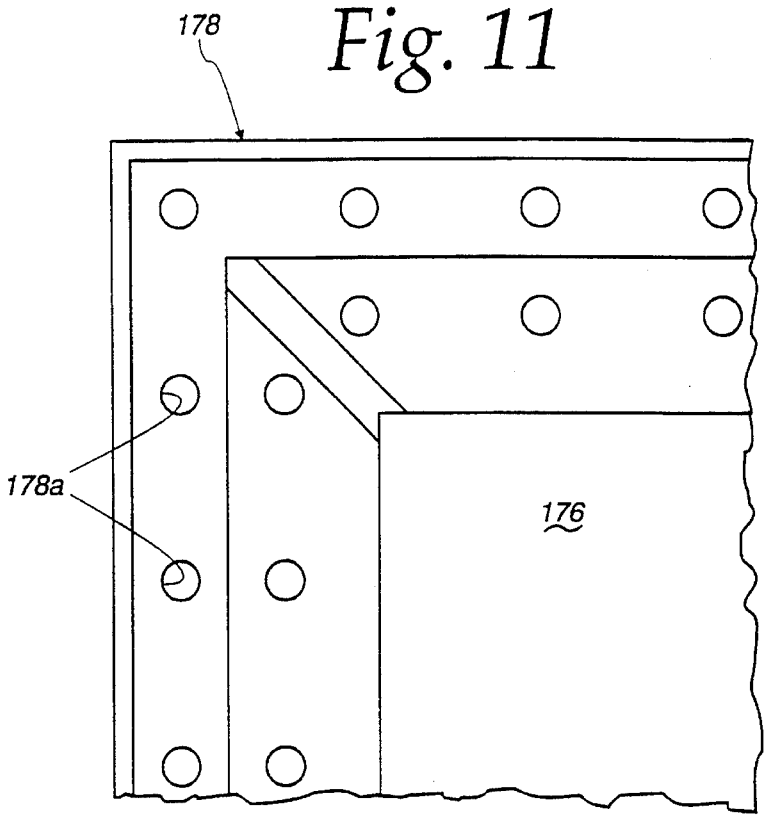
FIG. 11 is a plan view of an edge portion of the structural insulated panel of FIG. 10 illustrating details of its metal edge.
Figure 12:
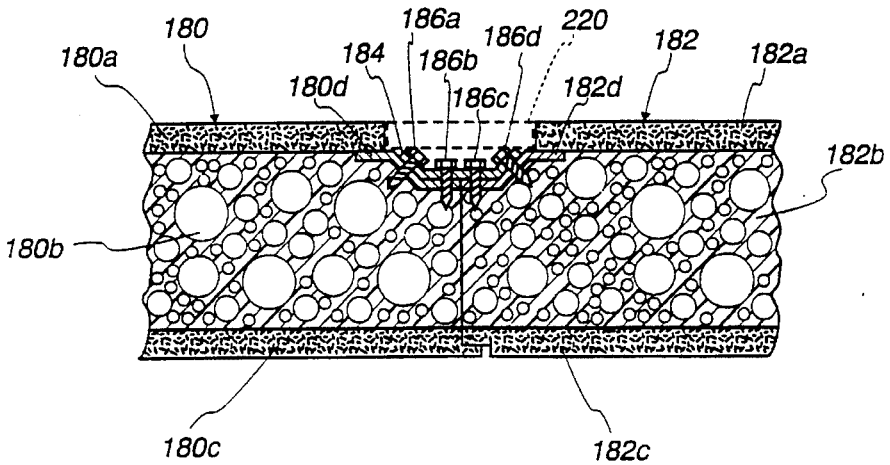
FIG. 12 is a partial sectional view showing a coupling arrangement for a pair of structural insulated panels as shown in FIGS. 10 and 11.

Referring to FIG. 10, there is shown another embodiment of a metal edged insulated panel 170 in accordance with the present invention. Panel 170 includes exterior and interior facings 174 and 176 attached to an inner foam insulating core 172. Disposed about the inner periphery of panel 170 and attached to the panel's inner core 172 and interior facing 176 is a contoured metal edge strip 178. A corner portion of the metal edge strip 178 disposed about the panel's interior facing 176 is shown in the plan view of FIG. 11 of a portion of the panel. The metal edge strip 178 of the panel 170 is provided with a plurality of pre-punched apertures 178*a* for connection to adjacent panels as shown in the partial sectional view of first and second panels 180 and 182 of FIG. 12. The first panel 180 includes interior and exterior facings 180*a* and 180*c* and an inner foam core 180*b*. Similarly, the second panel 182 includes interior and exterior facings 182*a* and 182*c* and an inner foam insulating core 182*b*. The apertures in the metal edge strips 180*d* and 182*d* of the first and second structural insulated panels 180, 182 are aligned with corresponding apertures in a metal channel connecting strip 184. Screws 186*a*, 186*b*, 186*c* and 186*d* are inserted through aligned apertures in the metal channel connecting strip 184 and metal edge strips 180*d* and 182*d* for securely coupling the first and second structural insulated panels 180, 182. The first and second panels 180, 182 are drawn together when screws 186*a* and 186*d* are tightened. A filler interior facing 220 shown in dotted line form in the figure may be provided to cover and conceal the connection hardware.

Figures 13, 14:
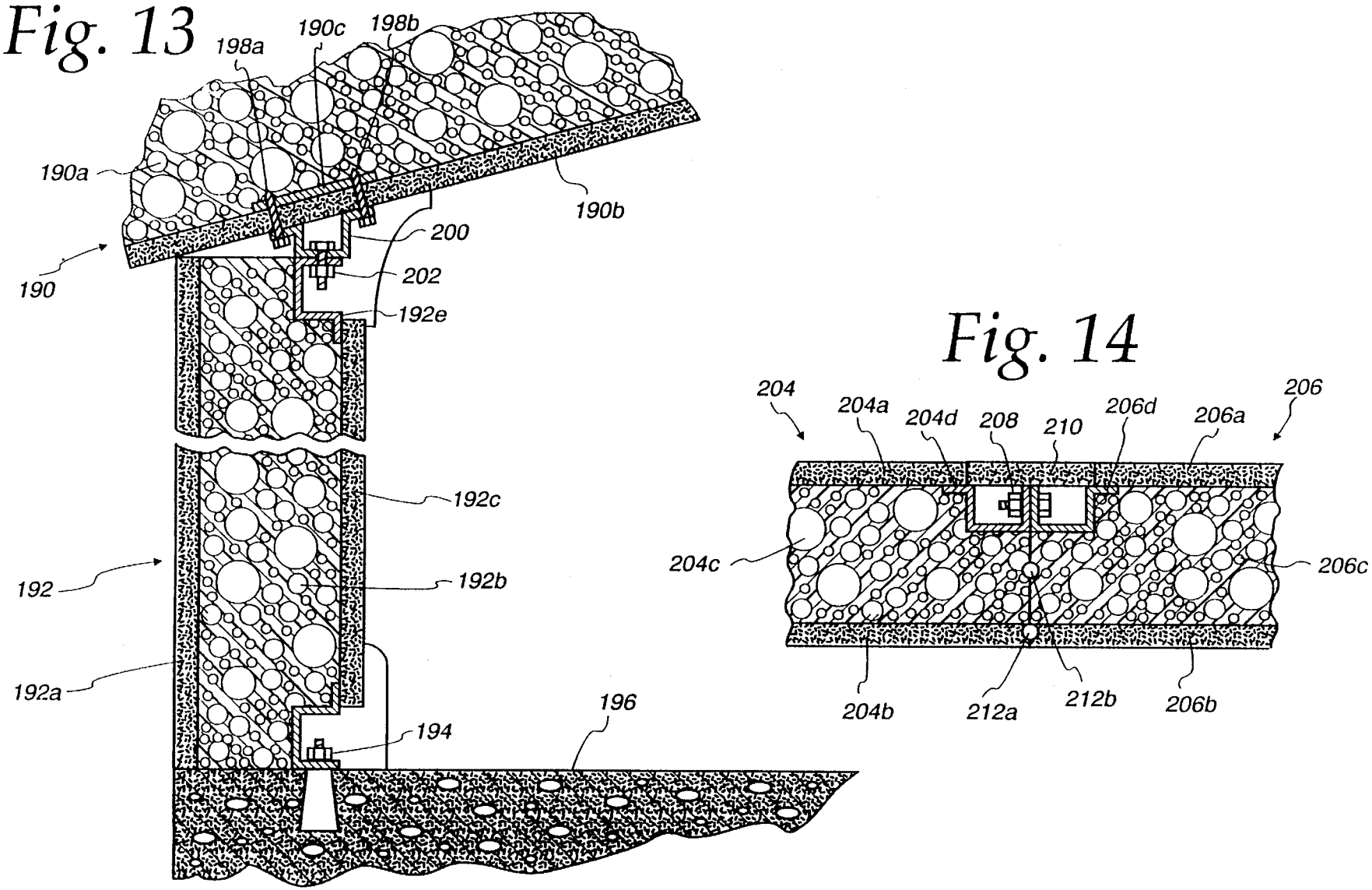
FIG. 13 is a partial sectional view showing another arrangement for coupling a structural insulated panel in accordance with the present invention to floor and roof members.
FIG. 14 is a partial sectional view showing details of the coupling between two structural insulated panels similar to the wall panel shown in FIG. 13.

Referring to FIG. 13, there is shown a vertical sectional view of another arrangement for connecting an exterior insulated wall panel 192 to a roof panel 190 and a concrete foundation 196. Insulated panel 192 includes exterior and interior facings 192*a* and 192*c* and an insulating foam core 192*b*. Disposed about the interior edge portion of panel 192 is a metal strip 192*e*. A lower portion of the metal edge strip 192*e* is affixed to the concrete foundation 196 by means of an anchor bolt and nut combination 194. An upper portion of the metal edge strip 192*e* is securely attached to the roof panel 190 by means of the combination of a roof panel connecting plate 190*c*, an angle roof attachment plate 200, screws 198*a* and 198*b*, and a nut and bolt combination 202. Roof connecting plate 190*c* is attached to an interior surface of the roof panel's interior facing 190*b* and is disposed in its inner foam core 190*a*.

Referring to FIG. 14, there is shown the manner in which a pair of insulated wall panels similar to the wall panel 192 shown in FIG. 13 may be securely coupled together. In FIG. 14, a first wall panel 204 includes inner and outer facings 204*a* and 204*b* and a foam core 204*c*. Similarly, a second wall panel 206 includes inner and outer facings 206*a* and 206*b* and a foam core 206*c*. The first wall panel 204 further includes metal edge strip 204*d* bonded to the panel's inner facing 204*a* and its foam core 204*c*. Similarly, the second wall panel 206 includes a metal edge strip 206*d* attached to the panel's inner facing 206*a* and its foam core 206*c* by conventional means such as an adhesive. Each of the metal edge strips 204*d* and 206*d* extends around the entire peripheral portion of its associated panel and includes a respective aperture for receiving a nut and bolt combination 208 for coupling the peripheral metal edge strips of adjacent panels 204 and 206 as shown in FIG. 14. An interior panel strip 210 may be placed over the metal edge strips 204*d* and 206*d* and maintained in position by an adhesive to conceal the panel coupling hardware. First and second sealant strips 212*a* and 212*b* may also be positioned intermediate the first and second panels 204 and 206 to provide a watertight seal between the panels.

Figure 17:
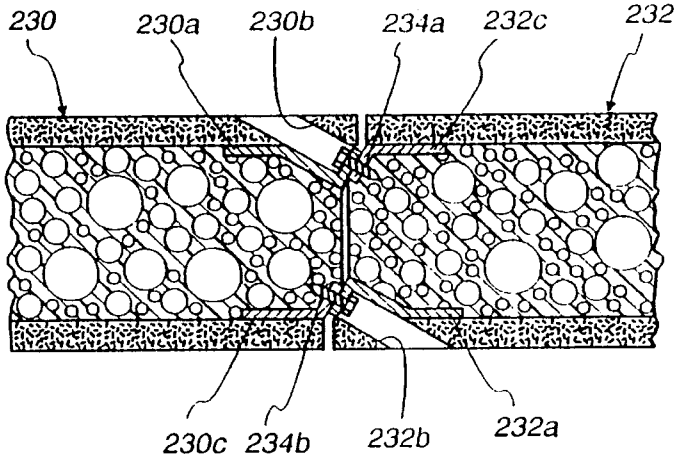
FIG. 17 is a partial sectional view showing the coupling between a pair of adjacent structural insulated panels as shown in FIG. 15.
Figure 15:
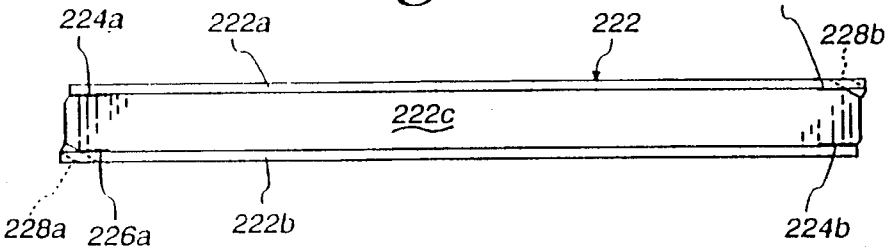
FIGS. 15 and 16 are top plan views of two other embodiments of structural insulated panels in accordance with the present invention.
Figure 16:
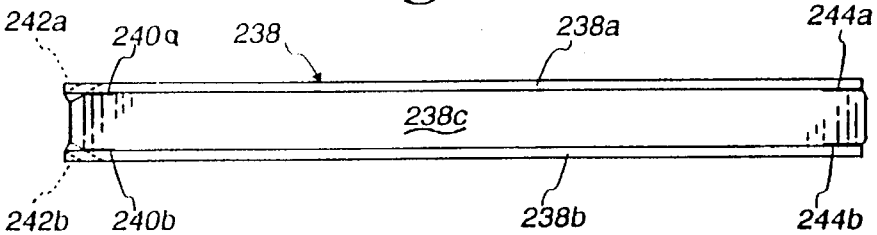
Figure 19:
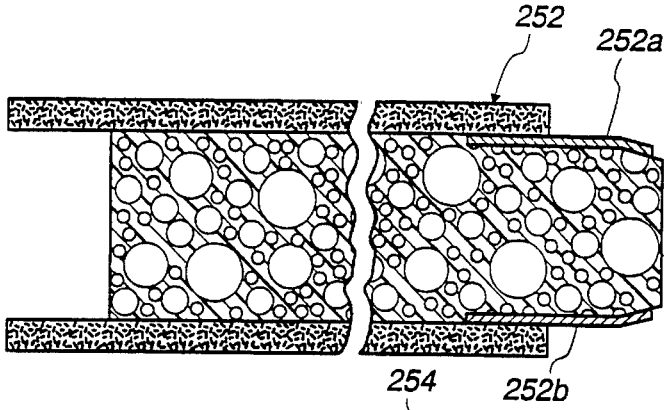
FIGS. 19–23 are partial sectional views of various embodiments of structural insulated panels in accordance with the present invention, each having a different coupling arrangement for attachment to an adjacent, identical panel.

Referring to FIGS. 15 and 16, there are shown two additional embodiments of structural insulated panels in accordance with the present invention. A first structural insulated panel 222 is shown in FIG. 15, with the manner in which two such panels may be coupled together shown in the sectional view of FIG. 17. Structural insulated panel 222 includes first and second outer facings 222*a*, 222*b* and an inner foam core 222*c*. Disposed on opposing lateral edge portions of panel 222 are a first pair of identical metal edge strips 224*a* and 224*b*. A second pair of identical metal edge strips 226*a* and 226*b* are also disposed on opposing lateral edges of panel 222. In addition, first and second edge slots 228*a* and 228*b* are disposed in opposing lateral edges of panel 222. The manner in which a pair of structural insulated panels 230 and 232 identical to the panel 222 shown in FIG. 15 may be coupled together is shown in FIG. 17. The first panel 230 includes first and second metal edge strips 230*a* and 230*c* as well as a first edge slot 230*b*. The second panel 232 similarly includes first and second metal edge strips 232*a* and 232*c* as well as an edge slot 232*b*. Metal edge strips 230*a* and 232*c* and metal edge strips 230*c* and 232*a* are arranged in abutting contact when the first and second panels 230, 232 are arranged edge-to-edge. Self tapping screws 234*a* and 234*b* are inserted respectively through metal edge strips 230*a*, 232*c* and 230*c*, 232*a* for securely coupling the first and second panels 230, 232 together.

Figure 18:
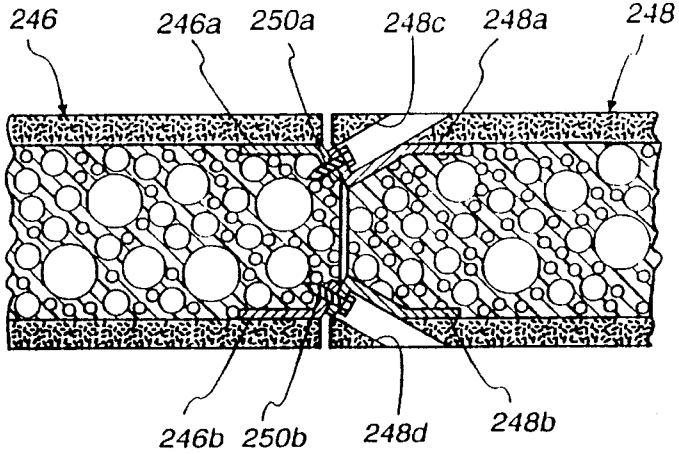
FIG. 18 is a partial sectional view showing the coupling between a pair of adjacent structural insulated panels as shown in FIG. 16.

Referring to FIG. 16, there is shown another embodiment of a structural insulated panel 238 in accordance with the present invention. Panel 238 includes first and second outer facings 238*a*, 238*b* and a foam insulating core 238*c*. Disposed on a first lateral edge of panel 238 are first and second metal edge strips 240*a* and 240*b*. Also disposed in the first lateral edge of panel 238 are first and second edge slots 242*a* and 242*b*. Disposed on the second, opposing edge of panel 238 are third and fourth metal edge strips 244*a* and 244*b*. The manner in which a pair of panels as shown in FIG. 16 may be coupled together is shown in the sectional view of FIG. 18. In FIG. 18, first and second panels 246 and 248 are shown coupled together by means of self-tapping screws 250*a* and 250*b* respectively inserted through metal edge strips 246*a*, 248*a* and 246*b*, 248*b*. In the structural insulated panels shown in FIGS. 15 and 16, each of the metal edge strips is bonded to the panel's inner foam core and an adjacent outer facing by means of an adhesive as in the previous embodiments.

Figure 20:
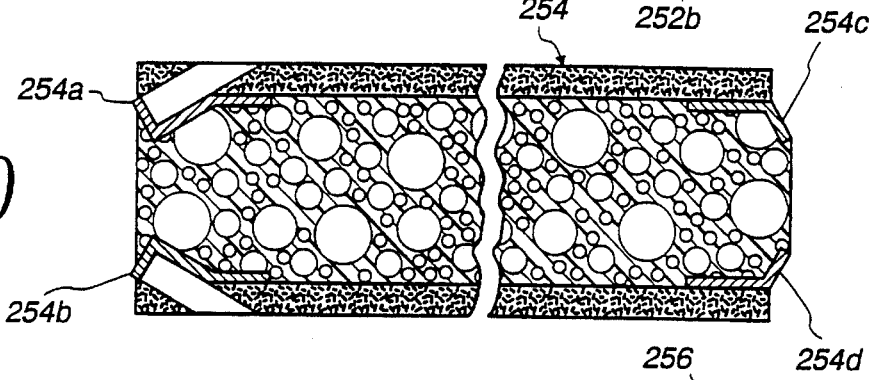
Figure 21:
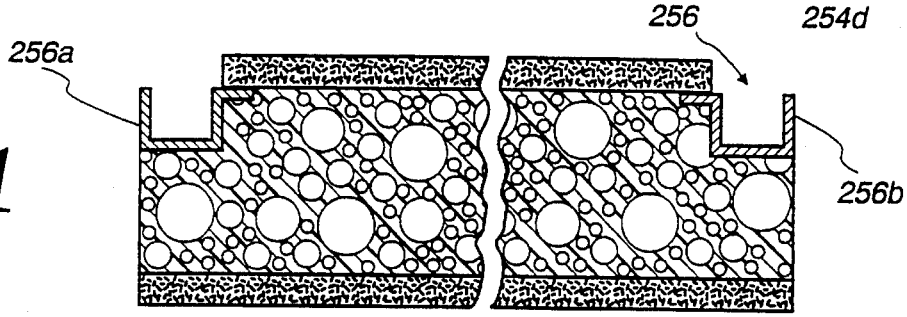
Figure 22:
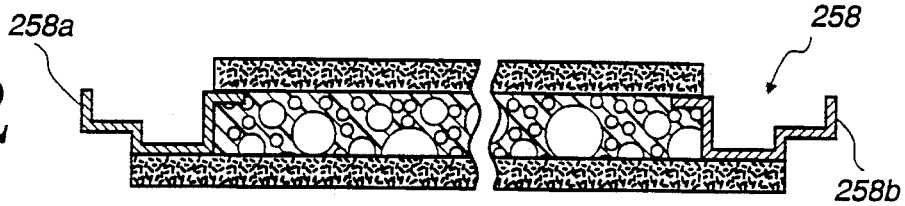

Referring to FIGS. 19, 20, 21, 22, and 23, there are shown various structural panel arrangements in accordance with the present invention. The structural insulated panel 252 shown in FIG. 19 includes first and second metal edge strips 252*a* and 252*b* and provides a tongue and groove connection between adjacent panels. Structural insulated panel 254 shown in FIG. 20 includes metal edge strips 254*a* and 254*b* on a first edge of the panel and metal edge strips 254*c* and 254*d* on a second, opposed edge of the panel. Additional details of structural panel 254 are shown in FIGS. 16 and 18. A pair of structural panels 254 as shown in FIG. 20 are connected together by means of a toe screw arrangement as previously described. The structural insulated panel 256 shown in FIG. 21 includes first and second metal edge strips 256*a* and 256*b* on opposed lateral edges thereof which provide a bolt together exterior coupling arrangement between adjacent panels. The structural insulated panel 258 shown in FIG. 22 includes first and second metal edge strips 258*a* and 258*b* which when coupled to adjacent, similar panels provides a bolt together interior modular coupling arrangement.

Figure 23:
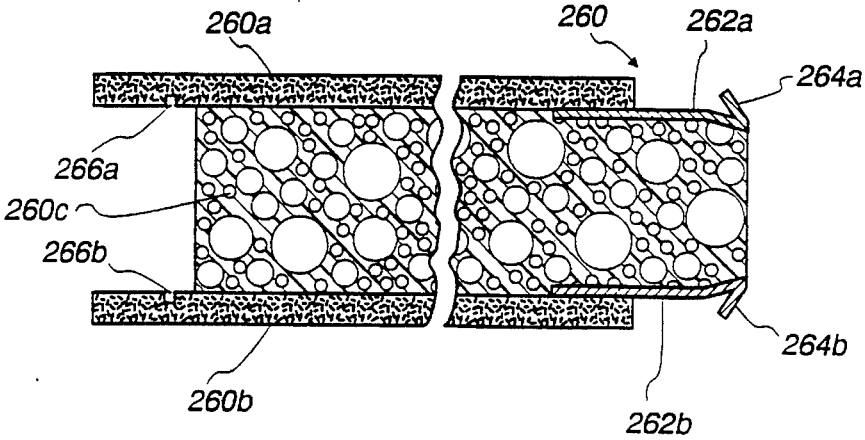

Referring to FIG. 23, there is shown yet another embodiment of a structural insulated panel 260 providing a tongue and groove with a catch type of coupling arrangement. Structural insulated panel 260 includes first and second outer facings 260*a* and 260*b* and a foam core 260*c* disposed therebetween. On one edge of panel 260 are disposed first and second metal edges 262*a* and 262*b* which are bonded to the foam core 260*c* as well as to first and second outer facings 260*a* and 260*b*, respectively. The opposed edge of panel 260 is provided with a pair of notches, or recesses, 266*a* and 266*b* respectively disposed on the inner surfaces of the first and second outer facings 260*a* and 260*b*. Notches 266*a*, 266*b* are adapted for receiving a respective tooth 264*a*, 264*b* on the distal end of one of the metal edges 262*a* or 262*b* of an adjacent panel. Thus, when a pair of panels 260 are positioned in abutting, edge to edge contact, teeth 264*a* and 264*b* respectively engage notches 266*a* and 266*b* for securely attaching the two panels. The tongue and groove with catch coupling arrangement provided by structural insulated panel 260 thus provides a locking feature for adjacent coupled panels.

Figure 24:
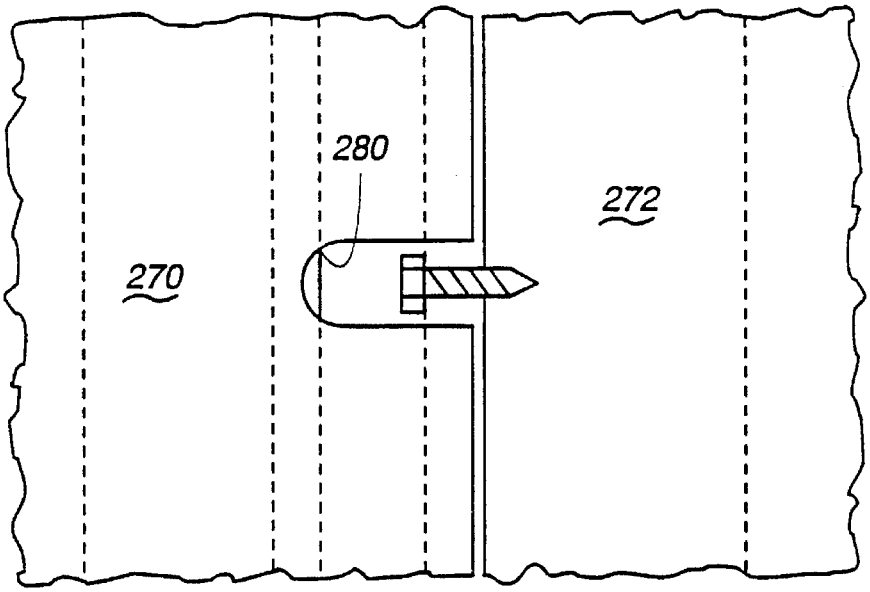
FIGS. 24 and 25 are partial plan and sectional views, respectively, of another embodiment of a structural insulated panel in accordance with the present invention and a coupling arrangement therefor.
Figure 25:
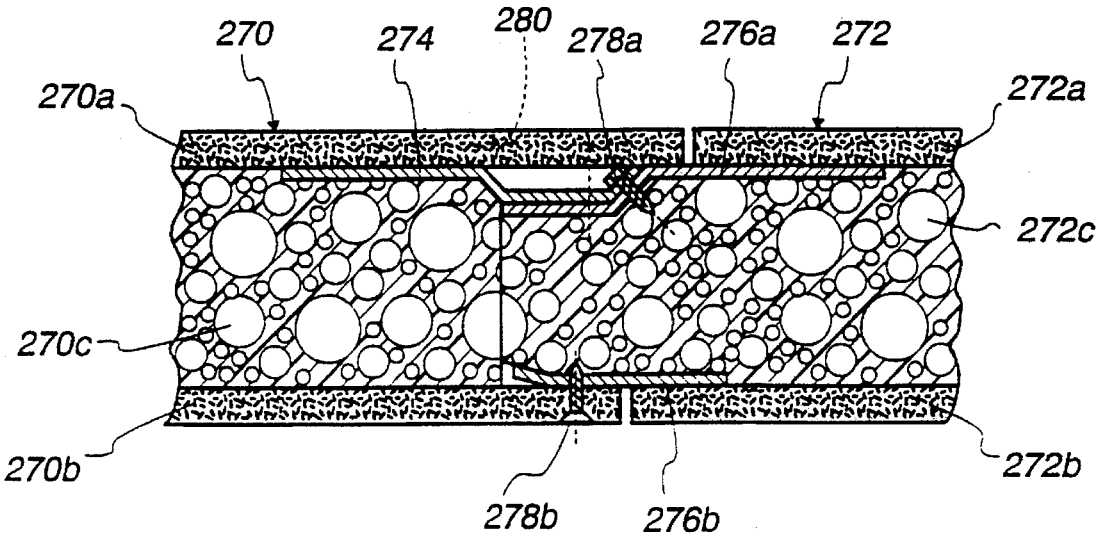

Referring to FIGS. 24 and 25, there are respectively shown partial plan and sectional views of a pair of structural insulated panels 270 and 272 in accordance with yet another embodiment of the present invention. A first structural panel 270 includes first and second outer facings 270*a* and 270*b* as well as an inner foam core 270*c*. Similarly, the second structural insulated panel 272 includes first and second outer facings 272*a* and 272*b* as well as an inner foam core 272*c*. The first panel 270 further includes a metal edge strip 274, while the second panel 272 also includes first and second metal edge strips 276*a* and 276*b*. With the first and second panels 270, 272 positioned in edge abutting contact, adjacent portions of metal edges 274 and 276*a* are arranged in an overlapping manner permitting a self-threading screw 278*a* to be inserted through the two metal strips. A second self-threading screw 278*b* is inserted through the second outer facing 270*b* of the first panel 270 and the second metal edge strip 276*b* of the second panel 272. A notch 280 in the first outer facing 270*a* of the first panel provides access to the overlapped arrangement of metal edge strips 274 and 276*a* to permit installation of screw 278*a* for maintaining the first and second panels 270, 272 in secure coupling.

Figure 26:
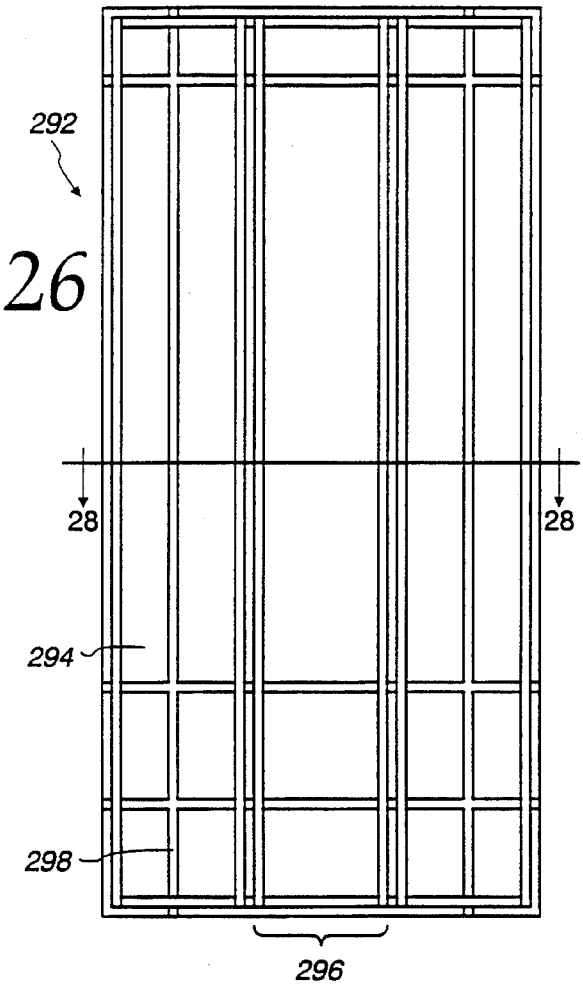
FIGS. 26, 27 and 28 are respectively plan, side elevational and sectional views of an open face insulated structural panel in accordance with yet another embodiment of the present invention, where
Figure 27:
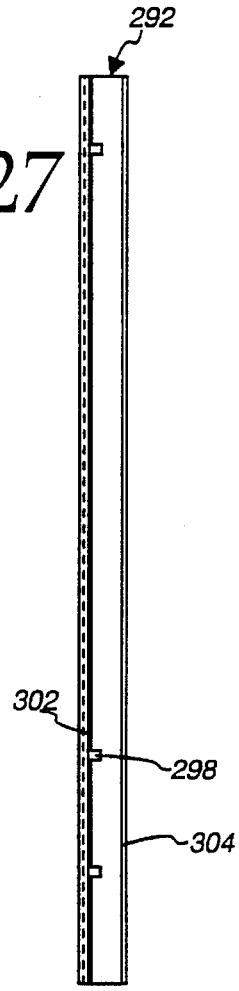
Figure 28:
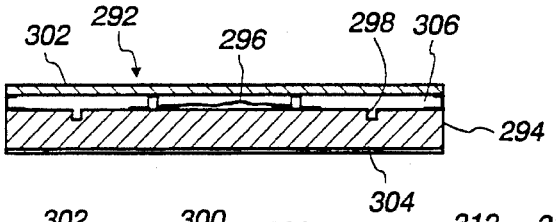
Figure 29:
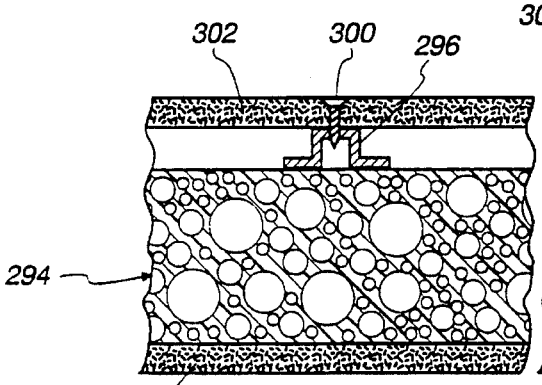
FIGS. 29 and 30 are sectional views of the panel shown in FIGS. 26, 27 and 28 illustrating additional details thereof.

Referring to FIGS. 26 and 27, there are respectively shown plan and lateral elevation views of an open face panel 292 in accordance with another embodiment of the present invention. Open face panel 292 includes an interior facing 302 which is omitted from FIG. 26 for simplicity. FIG. 28 is a sectional view of the open face panel 292 shown in FIG. 26 taken along site line 28—28 therein. In addition to its interior facing 302, open face panel 292 includes a foam core 294 having a matrix array of recesses, or channels, 298 disposed in a surface thereof. The linear array of recesses 298 provides a wire run, or chase, for installing electrical wiring in the open face panel. Disposed on the same surface of the foam core 294 as the recesses 298 are a plurality of spaced, linear metal strips 296. Metal strips 296 are generally U-shaped and are affixed to the surface of the foam core 294 by means of an adhesive and are further attached to the panel's interior facing 302 by means of a plurality of screws 300 as shown in the sectional view of FIG. 29. The inner metal strips 296 provide a gap, or airspace, 306 between the panel's foam core 296 and interior facing 302. This gap 306 may also be used for wire runs within the open face panel 292.

Figure 30:
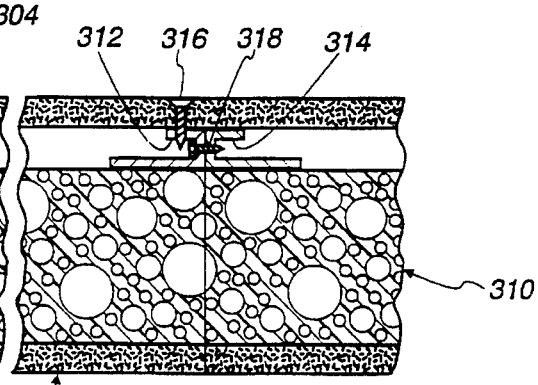

FIG. 30 is a sectional view showing the manner in which two open face panels 308 and 310 are coupled together by means of first and second brackets 312 and 314 and first and second screws 316 and 318. The open face panel 292 shown in FIGS. 26, 27 and 28 is typically shipped to a job site with the metal strips 296 exposed allowing wire runs to be routed within the panel's recesses 298, followed by attachment of the panel's interior facing 302. The open face panel 292 provides easy access to the interior of the panel for electrical wiring, is easily assembled on site, is lighter than conventional panels, and requires minimal accessory hardware for electrical wiring. Providing the inner metal strips 296 with sufficient surface adhering to the panel's inner foam core 294 permits the open face panel 292 to be used as a structural panel.

There has thus been shown a structural insulated panel with metal edges which provides a lightweight, high strength structural member. The inventive structural insulated panel is particularly adapted for use with gypsum and cement-type panel faces which are brittle and weak in tension. The metal edge strip disposed either around the panel's entire periphery or along one edge thereof reinforces the gypsum, or cement faces, spreading the concentrated load of the panel fastening screws. Current building codes typically require ½ of gypsum drywall (or equivalent) as a fire barrier on the inside of all residential structures. Most prior art structural panels use a composite wood panel for the inside face. This wood inside face must be covered with gypsum to meet these building codes. If the original inside face is gypsum, it eliminates the need for an entire facing of wood. By adhering the metal edge strip to the panel's periphery, the tensile strength of the gypsum panel is substantially increased, allowing the panel to be used as a structural panel. The lamination of the metal edge strip to the edge of a structural insulated panel in accordance with the present invention is a simple and inexpensive means for making a new building system for economical housing. The metal edge strip is bonded in shear to an external face of the panel as well as to its foam inner core to substantially increase the panel's structural strength. In effect, the metal edge strip becomes an extension of the facing. Using a high quality adhesive, the structural strength of the panel's facing may be continued through to the metal edge strip with only a short overlap. An overlap of four to eight times the thickness of the panel's facing is generally sufficient for full strength continuation of the structural strength of the panel's facing. Another advantage of the coupling arrangement made possible by the panel's metal edge strip is in the use of power drive systems rather than a hand-powered ratchet wrench for attaching the panels. The coupling arrangements described above thus provide improved access to the coupling screws or nut and bolt combinations for joining and mounting the structural insulated panels.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. An insulated structural panel comprising: a generally flat insulating core having a peripheral edge portion; first and second outer facings disposed on opposed lateral surfaces of said insulating core each having edge portions, wherein said peripheral edge portion of said insulating core extends beyond adjacent edge portions of said first and second outer facings; first and second thin metal strips disposed over and attached to said peripheral edge portion of said insulating core forming a tongue structure, wherein each of said panels further includes a respective recessed groove on an opposed peripheral edge portion thereof, wherein each recessed groove is adapted to receive the tongue structure of an adjacent panel; and coupling means for securely connecting at least one of said metal strips and said peripheral edge portion of said insulating core to a second insulated structural panel.

2. The structural panel of claim 1 further comprising third and fourth thin metal strips attached to the recessed groove of each of said panels and adapted to receive said coupling means.

3. An insulated structural panel comprising:

a generally planar insulating core having a peripheral edge portion;

first and second outer facings disposed on opposed lateral surfaces of said insulating core, wherein each of said outer facings includes a respective peripheral edge portion and wherein a peripheral edge portion of said insulating core extends beyond adjacent edge portions of said outer facings along a first edge thereof to form a tongue-like structure and wherein peripheral edge portions of said outer facings extend beyond an adjacent edge portion of said insulating core along a second, opposed edge thereof to form a groove in an edge of said structural panel;

a first thin metal strip disposed intermediate and affixed to said insulating core and one of said outer facings along first adjacent edges thereof;

a second thin metal strip disposed intermediate and affixed to said insulating core and said one of said outer facings along second, opposed edges thereof; and coupling means for securely connecting said structural panel to a second identical structural panel when the tongue-like structure of one of said panels is inserted in the groove of the other panel, wherein said coupling means engages said first metal strip in one panel and said second metal strip in the other panel.

4. The structural panel of claim 3 further comprising third and fourth thin metal strips each affixed to said insulating core and one of said outer facings and respectively disposed along the first and second edges thereof, wherein said third and fourth metal strips respectively form a portion of said tongue-structure and said groove of the structural panel.

5. The structural panel of claim 4 wherein said coupling means further engages the third metal strip of said one panel and the fourth metal strip of said other panel.

6. The structural panel of claim 5 wherein each of said first and third metal strips includes a respective inwardly angled distal edge to facilitate insertion of the tongue-like structure of said one panel into the groove of said other panel.

7. The structural panel of claim 3 wherein said coupling means includes threaded coupling pins or an adhesive.

8. The structural panel of claim 7 wherein said adhesive is epoxy cement or glue.

9. The structural panel of claim 3 wherein said insulating core is foam.

10. The structural panel of claim 3 further comprising an adhesive for affixing said first and second metal strips to said outer facings and said insulating core.

11. The structural panel of claim 4 further comprising an adhesive for affixing the metal strips to said outer facings and said insulating core.

12. The structural panel of claim 3 wherein said outer facings are comprised of gypsum or cement.

13. The structural panel of claim 3 wherein said metal strips are aluminum or galvanized steel having an epoxy paint outer coating.

* * * * *